US007347764B2

(12) United States Patent
Choi

(10) Patent No.: US 7,347,764 B2
(45) Date of Patent: Mar. 25, 2008

(54) TOY RACING GAME

(75) Inventor: Kei Fung Choi, Causeway Bay (HK)

(73) Assignee: Silverlit Toys Manufactory, Ltd., Hong Kong (HK)

( * ) Notice: Subject to any disclaimer, the term of this patent is extended or adjusted under 35 U.S.C. 154(b) by 75 days.

(21) Appl. No.: 11/047,004

(22) Filed: Jan. 31, 2005

(65) Prior Publication Data

US 2005/0176510 A1 Aug. 11, 2005

Related U.S. Application Data

(60) Provisional application No. 60/542,732, filed on Feb. 5, 2004.

(51) Int. Cl.
*A63H 18/00* (2006.01)

(52) U.S. Cl. ..... 446/446

(58) Field of Classification Search ..... 463/6, 463/58–62, 1; 273/246, 86; 446/446, 445, 446/456, 460, 468; 104/242, 305
See application file for complete search history.

(56) References Cited

U.S. PATENT DOCUMENTS

| | | | | |
|---|---|---|---|---|
| 3,071,377 | A * | 1/1963 | Willett | 463/58 |
| 3,717,346 | A * | 2/1973 | Merino et al. | 463/58 |
| 4,090,713 | A * | 5/1978 | DeCesare | 463/62 |
| 6,394,898 | B1 * | 5/2002 | Nagao et al. | 463/6 |

* cited by examiner

*Primary Examiner*—Xuan M. Thai
*Assistant Examiner*—Eric M. Thomas
(74) *Attorney, Agent, or Firm*—Greenberg Traurig, LLP

(57) ABSTRACT

A racing toy game comprises a multi-track closed circuit, a respective starting gate for each respective track of the circuit, a finishing post for each respective track of the circuit. There are multiple movable elements each respectively being for traversing a respective track of the circuit and thereby racing in relation to other movable elements in other tracks. A starter is associated with each respective starting gate, the starter having been for operating the respective gates substantially simultaneously to permit initiation of the race. Initiating of the race permitting the respective movable elements to traverse a respective track from the starting gate towards the finishing post. The movable elements are represented by animals, selectively horses.

22 Claims, 9 Drawing Sheets

FIG. 11
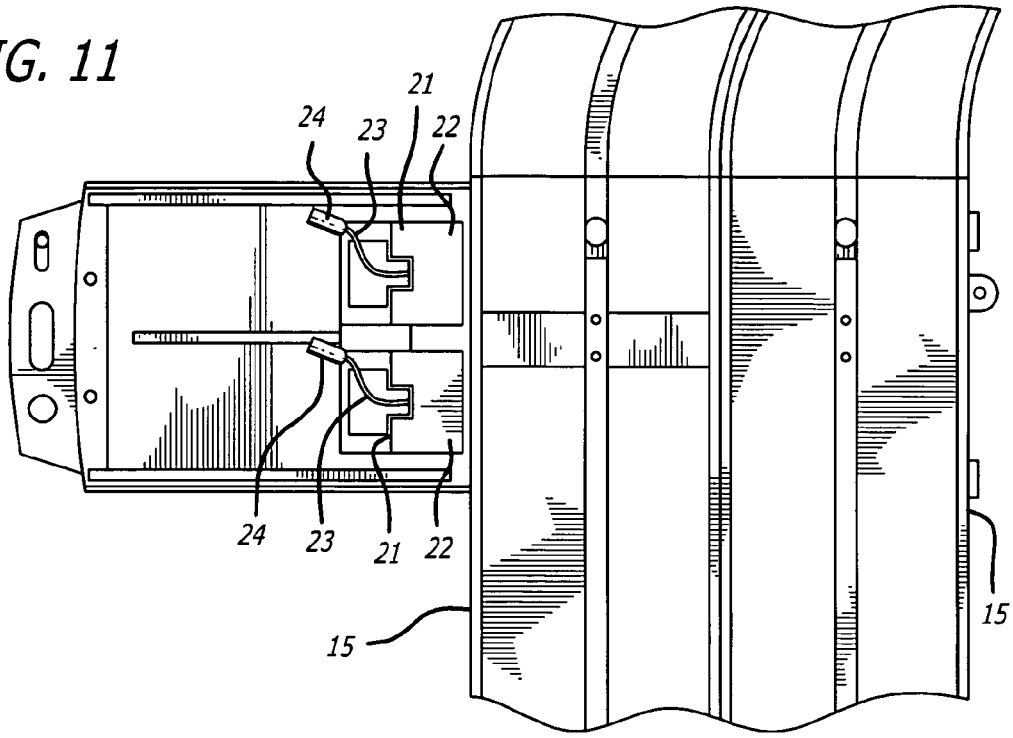
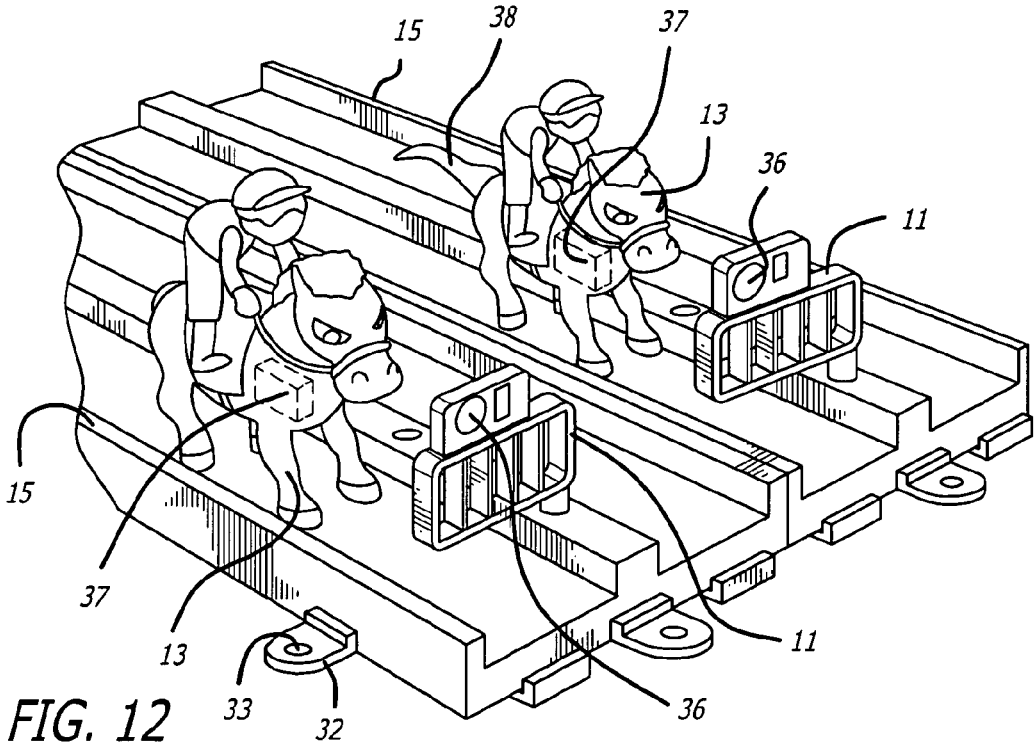
FIG. 12

FIG. 13
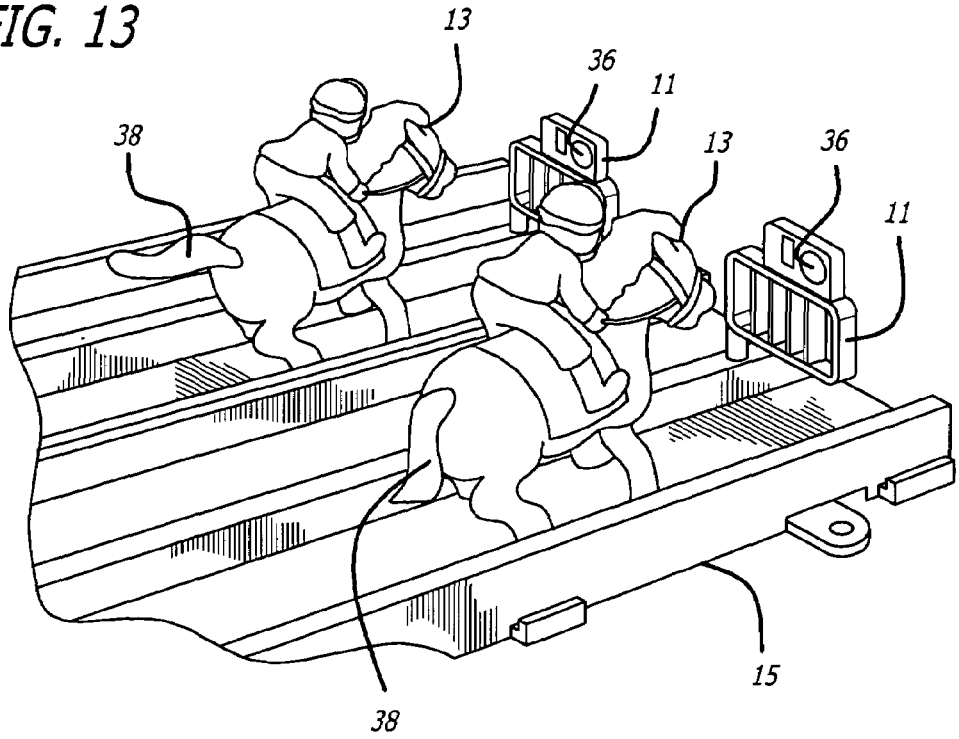
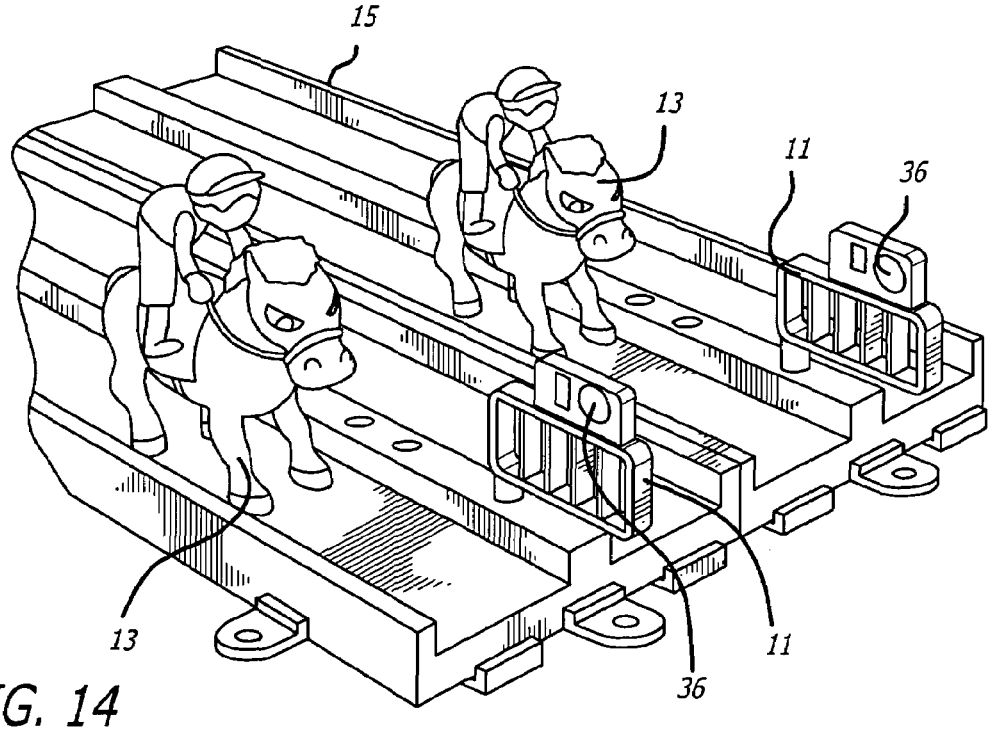
FIG. 14

TOY RACING GAME

RELATED APPLICATION

This application claims priority to Provisional Application No. 60/542,732, filed Feb. 5, 2004, the contents of which are incorporated herein in their entirety.

BACKGROUND

This invention relates to a toy racing game. In particular, this invention is concerned with a racing game around a closed circuit.

Many different kinds of games and toys which involve racing are known. These games and toys are also known to have different movable elements race around a closed track in competition with other movable elements.

The known different toys have limitations in the characteristics of the movable elements, the abilities to start and finish races and the entertainment provided by these racing games.

It is an object of the present invention to minimize the disadvantages of known games and racing toys.

SUMMARY

A racing toy game comprises a multi-track closed circuit, a respective starting location, place or a gate for each respective track of the circuit, a finishing location, place or post for each respective track of the circuit. There are multiple movable elements, for instance representative of a different kind of animal or vehicle, each respectively being for traversing a respective track of the circuit and thereby racing in relation to other movable elements in other tracks.

The movable elements in one form are represented by animals, selectively horses.

A starter is associated with each respective starting gate, location or place. The starter is for operating the respective gates location or place substantially simultaneously to permit initiation of the race. Initiating of the race permits the respective movable elements to traverse a respective track from the starting gate location or place towards the finishing post, location or place. The starting gate, location or place for each respective track and is connected such that initiation of the race effectively operates all the gates, locations or places simultaneously.

The starting gate location or place for each track is located at a different relative location on the track relative to a different track. With a closed track, the movable element for the respective track traverses substantially the same distance between its starting gate location or place and a finishing post, location or place. The finishing location, place or post is aligned for tracks.

The starting gate for each track is interlinked by a lever system. The lever system is functional essentially below the level of the tracks. The starting mechanism is associated with the tracks, and the starting mechanism is a lever connected with a lever associated with each track. The lever associated with each track is associated with the starting gate of each track.

Each starting gate includes an element hinged to move from a position across the track to the position substantially parallel and adjacent to the track. In the position across the track, the gate, which includes a metal element is located such that the metal element interacts with an electromagnetic motor in each of the movable elements.

When the metal element is in relatively closer adjacency with the electromagnetic motor in the movable element, the movable element is rendered stationary. When the metal is in a position relatively removed from the movable element the electromagnetic motor in the movable element is activated to permit motion of the movable element.

The movable element includes a rechargeable battery, and the toy includes a source for recharging the rechargeable battery. The movable elements each include a switch for permitting activation of an electromagnetic motor in the movable element.

An electronic sensor is associated with the finishing post. The electronic sensor is for determining which movable element reaches the finishing post first and selectively it can sense other movable elements at different times.

Each movable element, in one form, includes an electromagnetic motor and includes a variable resistor, the variable resistor being adjustable thereby to adjust the speed of the movable element.

Alternatively, in another form, the movable element is propelled along the track on the action of a lever or pressure or without the action of an electromagnetic motor.

The toy and game are further described with reference to the accompanying drawings.

DRAWINGS

The above-mentioned features and objects of the present disclosure will become more apparent with reference to the following description taken in conjunction with the accompanying drawings wherein like reference numerals denote like elements and in which:

FIG. 11 is a top view of two sections of track, with the starting barn in relationship to the tracks, and the recharging areas opened with the wires exposed, the wires having terminals being for connection to the mouths of respective horses which, contain contacts and terminals.

FIG. 12 is a perspective view showing two tracks with two gates respectively closed in front of two respective horses, the metal elements being contained in the top area of each gate.

FIG. 13 is a different view of the respective horses on each respective track with the respective gates closed.

FIG. 14 is a perspective view of two tracks in adjacent relationship with two horses and the respective gates opened.

DETAILED DESCRIPTION

Figure 1:
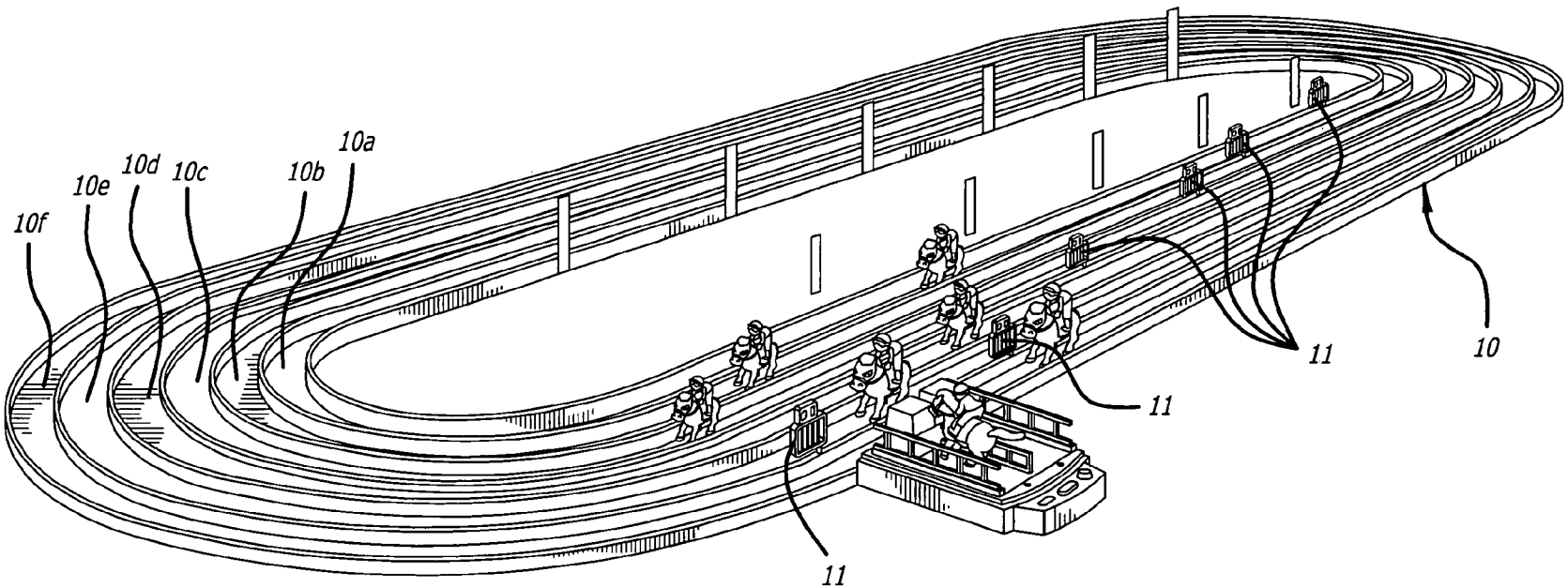
FIG. 1 is a perspective view showing several closed tracks having 6 lanes or tracks for 6 horses.
Figure 2:
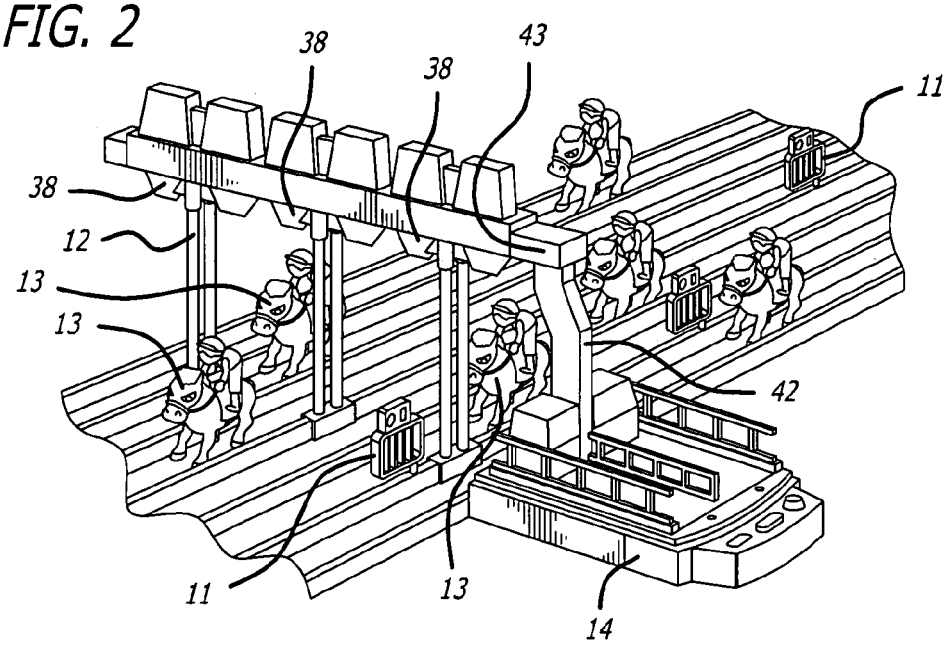
FIG. 2 is a perspective view showing six tracks in relationship to the finishing post and also showing two starting gates and several horses in the respective tracks.
Figure 3:
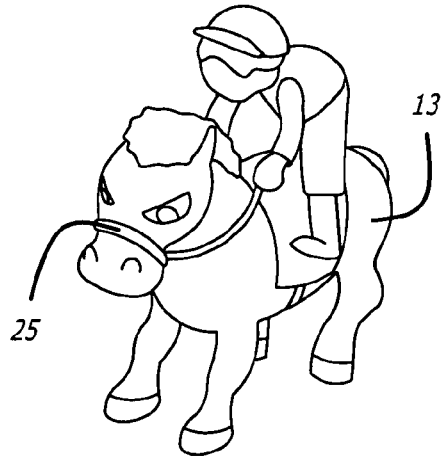
FIG. 3 is a perspective view of a horse.
Figure 4:
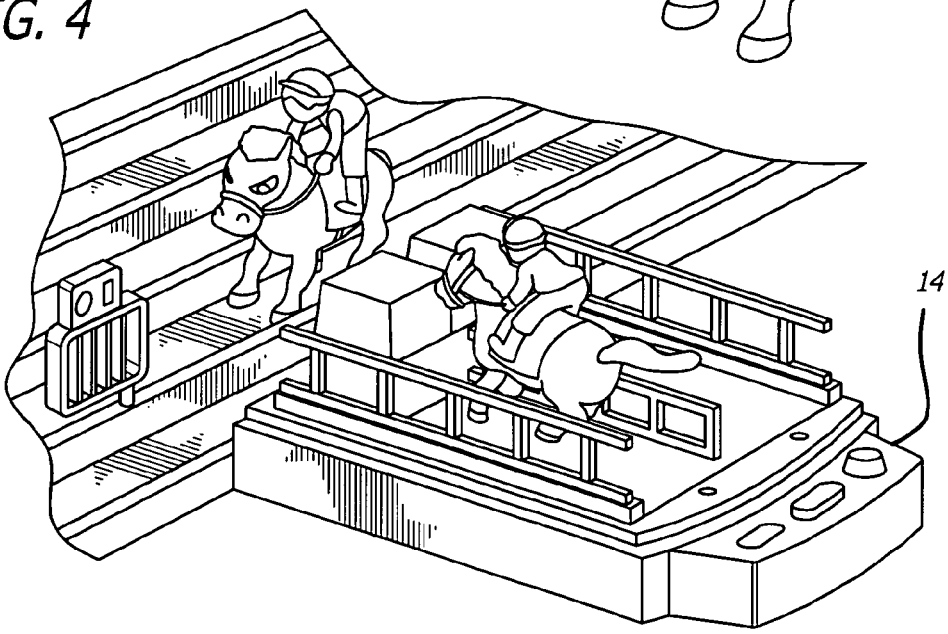
FIG. 4 is a perspective view of the starting barn in relationship to a horse, which is in the barn for recharging.

The game and toy are now described with reference to an example which is not to be considered is limiting. This is purely an illustration of the toy and game.

A racing toy game comprises a multi-track closed circuit 10, and a respective starting gate 11 for each respective track 10*a* to 10*f* of the six track circuit. The starting post 11 for the inside track 10*a* is further removed from the finish post 12 than the starting post 11 for the outside track 10*f*.

The finishing post 12 for each respective track 10*a* to 10*f* of the circuit 10. There are multiple movable elements, namely horses 13 each respectively being for traversing a respective track 10*a* to 10*f* of the circuit 10. Thereby, the horses 13 race in relation to each other with each horse on the respective track.

A starter barn 14 is associated with each respective starting gate 11. The starter barn 14 is connected for operating the respective gates 11 substantially simultaneously to permit initiation of the race. Initiating of the race permitting the respective horses 13 to traverse a respective track 10*a* to 10*f* from the starting gate 11 towards the finishing post 12. As indicated, the movable elements are represented by animals, selectively horses.

The starting gate 11 is for each respective track 10*a* through 10*b* and are connected such that initiation of the race effectively operates all the gates 11 simultaneously. The starting gate 11 for each track 10*a* to 10*f* is located at a different relative location on the track relative to a different track.

With a closed track 10, the horses 13 for the respective tracks 10*a* to 10*f* traverse substantially the same distance between its starting gate 11 and a finishing post 12. The finishing post 12 is aligned for all the tracks 10*a* to 10*f*.

Figure 5:
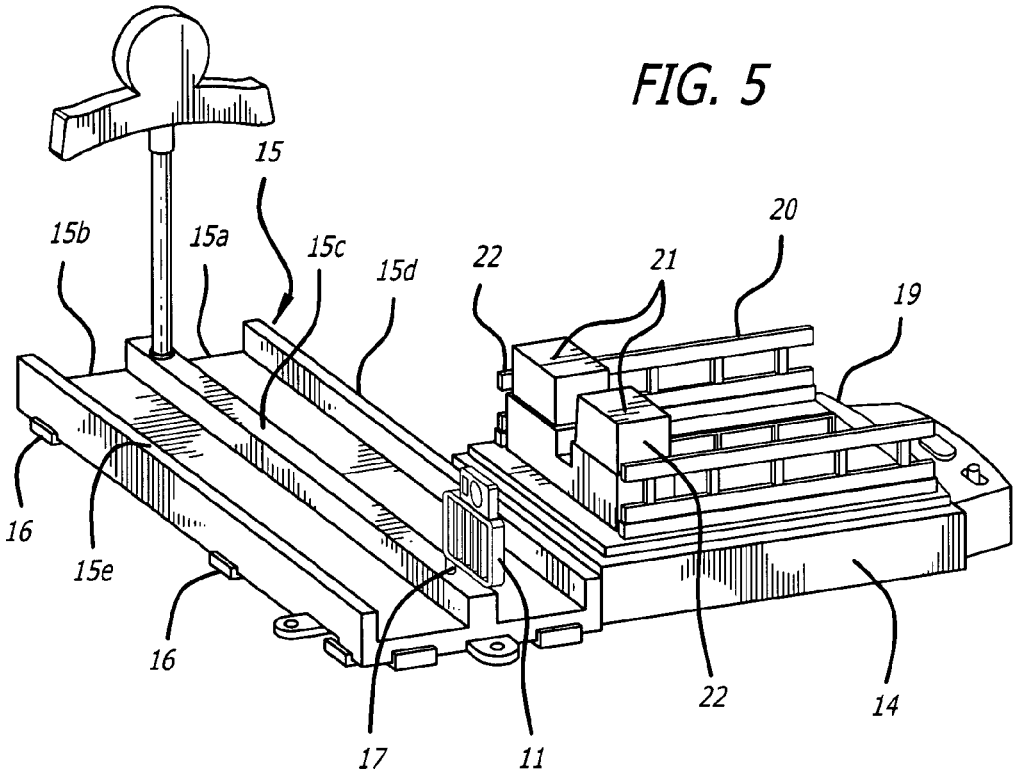
FIG. 5 is a perspective view of the starting barn, a starting gate, and one track when together with outlets for having a cable for recharging horses.
Figure 6:
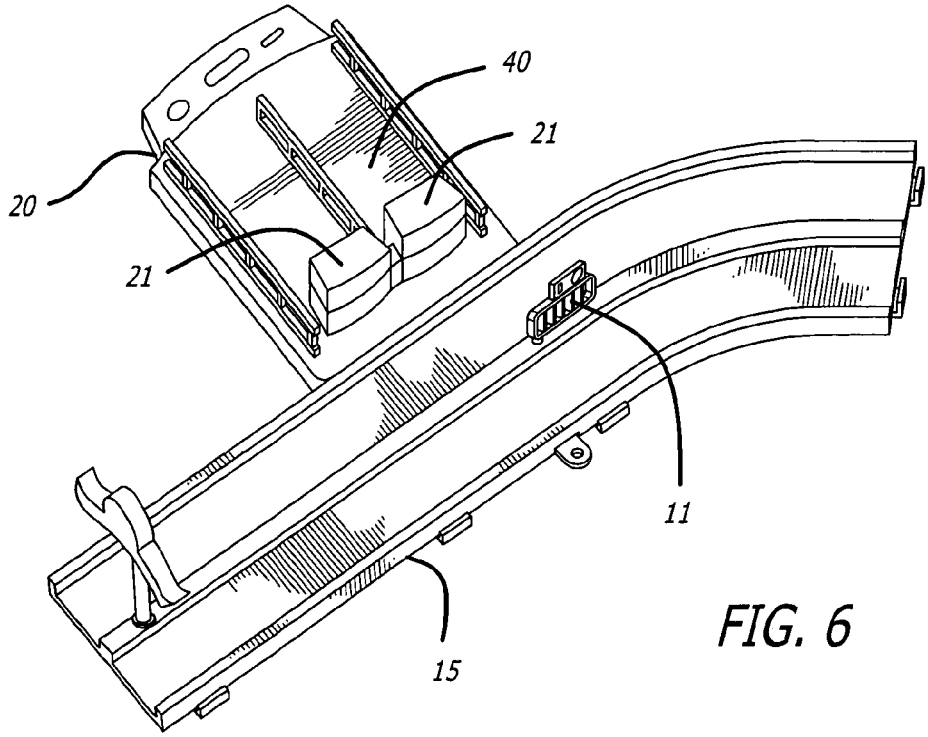
FIG. 6 is a perspective view of two sections of track together with the starting barn.
Figure 7:
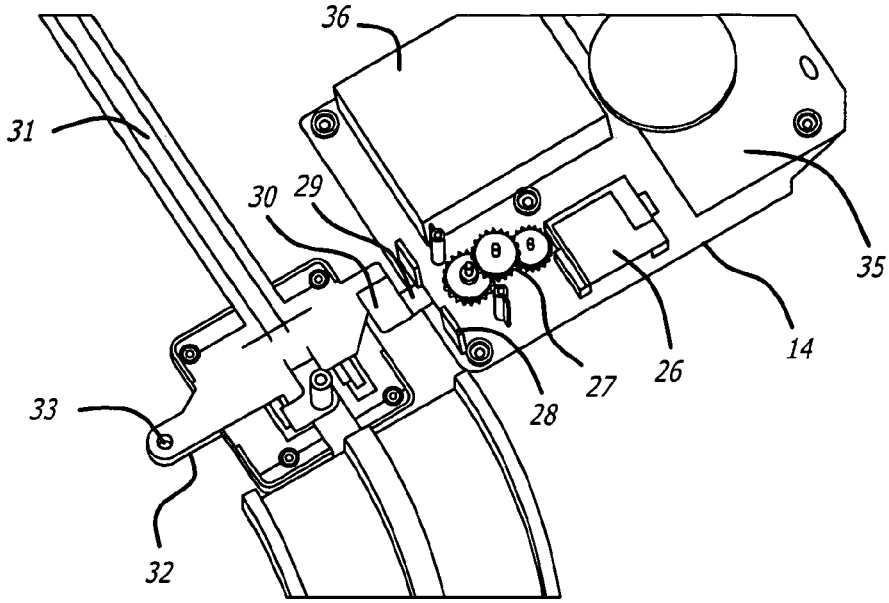
FIG. 7 is a perspective view of the top part of the starting barn with the cover removed, showing its motor, a circuit board, and part of the lever system for operating the gates of the track.
Figure 8:
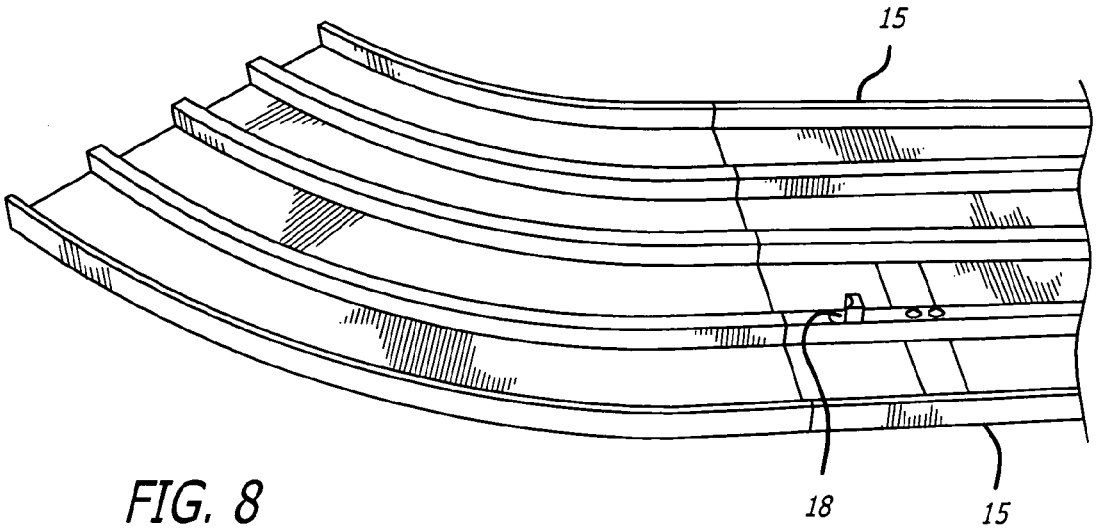
FIG. 8 shows two sections of track together with a respective portion from one section, the effective portion being associated with the finishing post.
Figure 9:
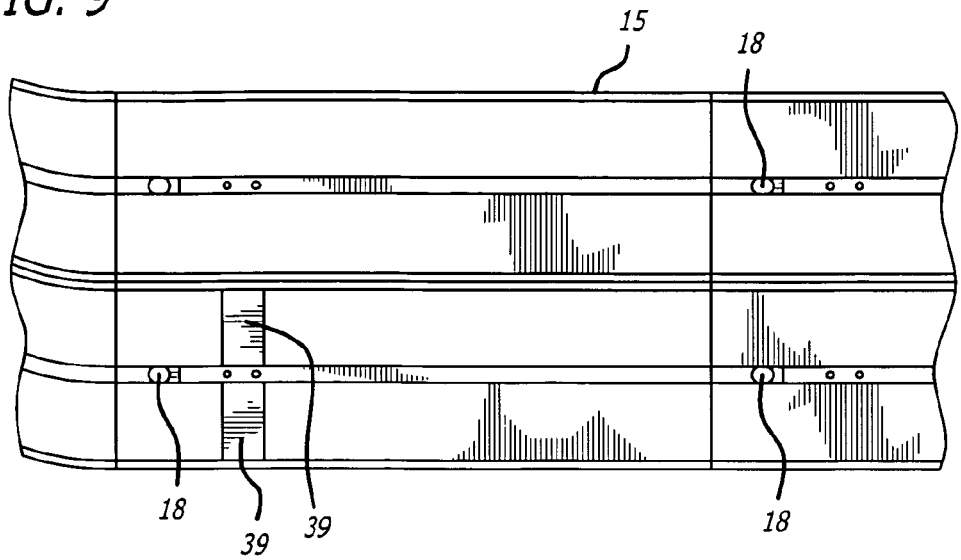
FIG. 9 is a top view showing three interconnected sections of two tracks with the averages for receiving the starting gates.
Figure 10:
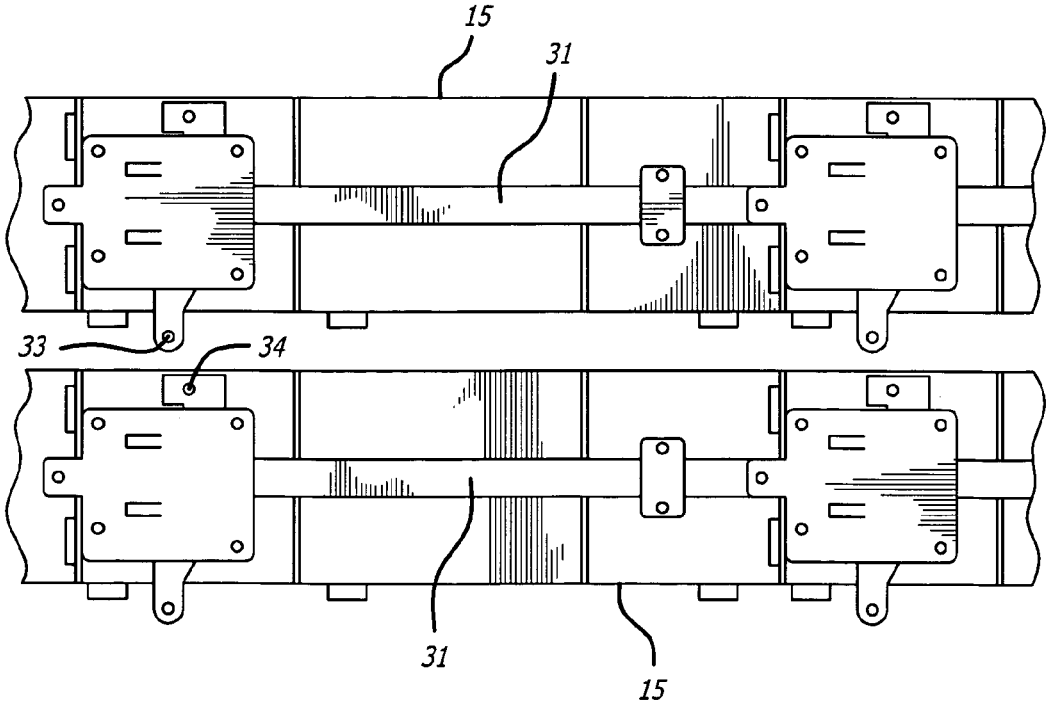
FIG. 10 is an underside view of two sections of track showing the lever system underneath the tracks, that lever system being unconnected between the tracks.
Figure 15:
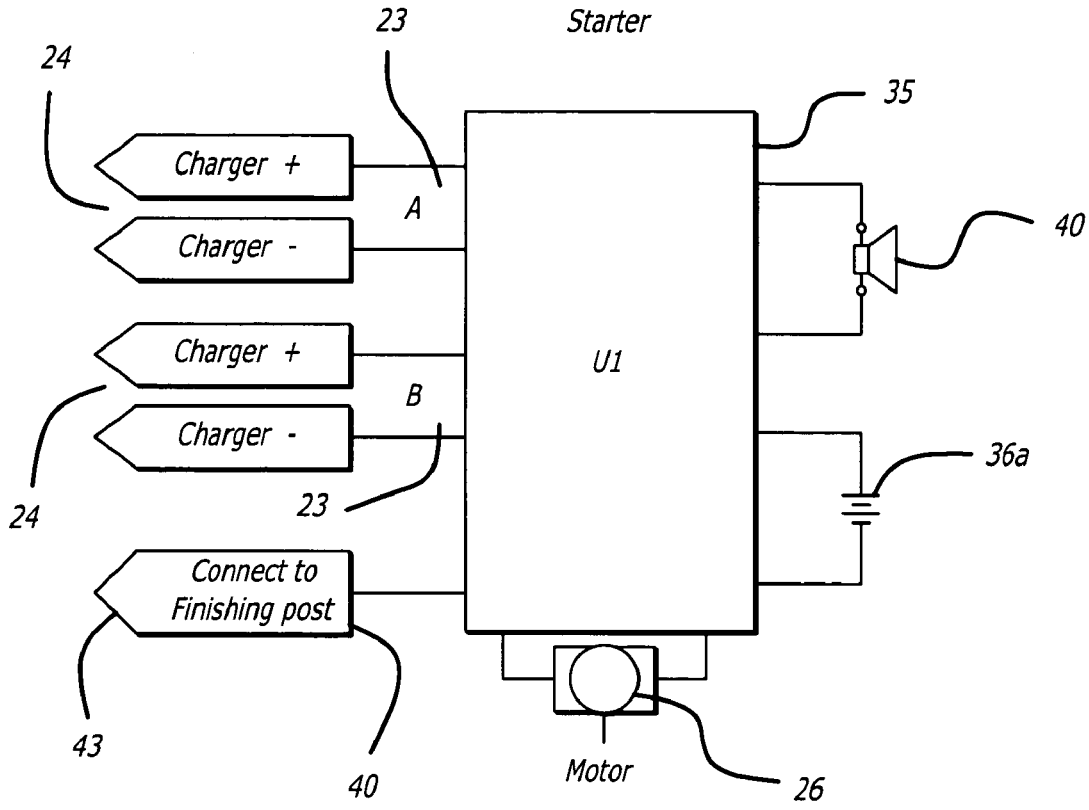
FIG. 15 is a block diagram of a circuit board which is located inside the barn.

The starting gate 11 for each track 10*a* to 10*f* is interlinked by a lever system 15, the lever system 15 being functional below the level of the track structure on which the horses 13 run. Each of the tracks 10*a* through 10*f* is made up of multiple sections of straight track and curved track service to form an elliptical path. The inside track 10*a* is relatively shorter than the outside track and that is why the starting gate is removed father from the finish post 12 of all the tracks. A straight track portion 15 is shown in FIG. 5. Each Portion 15 has a pair of tracks 15*a* and 15*b* in adjacency. Between the tracks 50*a* and 15*b* there is a median 15*c*. Likewise to either side of the tracks 15*a* and 15*b* there are medians 15*d* and 15*e*. The track 15 would engage on the side of 15*e* another straight track portion on the inside and likewise that straight track in turn would engage in other straight track portion of its inside. There are clip formations 16 which ensure the positive contact of the different straight track portions.

On the central median 15 see there is mounted the gate 11 which in FIG. 5 is shown in the open position. It is hinged around a post 17 which fits in a hole or slot 18. The gate 11 can move to be across the track portion 15*a* and thereby bar the horse 13 from moving along the track. Alternatively, the gate 11 can be in the open position and the horse 13 can move along the track.

The starting barn 14 includes a casing 19 for the barn 14. On top of the casing 19 there is a platform 20 and adjacent to the track 15 there are two rechargeable housings 21. When the cover 22 is removed from the housings 21 wires 23 are exposed with respective terminals 24. The terminals 24 engage the mouth 25 of the horse 13. The mouth of the horse 13 as appropriate connectors so the recharging of a rechargeable battery in each of the horses 13 can be effected.

The starting mechanism is associated with the tracks, and the starting mechanism is a lever connected with a lever associated with each track. The lever associated with each track is associated with the starting gate of each track.

Inside the barn 14 there is a motor 26 which through a gear system 27 operates a lever 28 with a protruding portion 29 to engage a mating lever on a protruding portion 30. This connects underneath the track 15 and moves a longitudinal rod 31 forwardly and backwardly underneath the track 15. Extending on the opposite side of the protruding portion 30 there is an equivalent protruding portion 32 with an aperture 33. The aperture 33 engages a post 34 in an adjacent slot mechanism of the adjacent track 15. In this manner the rod 31 moves underneath the track 15 so that different gates 11 on the top of the track are activated. Each of the rods 31 is connected with the hole 18 so that the post 17 can be rotated as required and thereby open and close the gates 11.

As indicated, the operative gate 11 for each particular track is located at a different position along the track and is through this interlinked lever system of rods between respective track sections 15 the action from the starting barn is transmitted to different tracks at their respective starting gates 11.

Inside the starting barn there is also a circuit board 35 for operating the game and toy. There is also a power supply 36*a* as needed. This can be multiple replaceable batteries.

Each gate 11 includes the post element 17 which is hinged to move from a position across the respective track to the position substantially parallel and adjacent to the respective track. In the position across the track the gate 11, which includes a metal element 36 which is such that the metal element 36 interacts with an electromagnetic motor figuratively illustrated as 37 in each of the horses 13. Each of the motors 37 is connected with the legs of the respective horses 13 so that the operation of the motor 37 can cause the horse 13 to move forwardly on the respective track. Each motor 37 also is effectively activated or deactivated by the proximity to the metal element 36. In each of the horses 13 there is also an on-off switch. This is operated as a switch by the tail 38 of each of the horses so that if the tail is in the up position the motor can either be in the on position and if it is in the down position it can be in the off position depending on the design of each horse 13 and its respective motor 37.

When the metal element 36 is in closer adjacency with the electromagnetic motor 37 in the horse 13, the horse 13 is rendered stationary. When the metal 36 is in a position removed from the horse 13, the electromagnetic motor 37 in the horse 13 is activated to permit motion of the horse 13.

The horse 13 includes a rechargeable battery, and the toy includes a battery source 36*a* for recharging the rechargeable battery. The horse 13 includes the tail switch for permitting activation of an electromagnetic motor 37 in the horse 13.

An electronic sensor 38 is associated with the finishing post 12, the electronic sensor 38 operates with a reflective the face 39 for determining which horse 13 reaches the finishing post 12 first and selectively sensing other horse 13 at different times. Between the two recharging posts 21 there is an electrical connector 40 which engages an upright support 42 which is electrically connected and 43 with the finishing post construct 12 which has the respective sensors 38 at the top of the finishing post 12. Accordingly wherein a horse 13 interacts with the reflective signal from plate 39 to the sensor 38 a signal can be given that a horse 13 has crossed the finishing line. This is signaled to the circuit board 35.

Sycamore 35 also operates a speaker 40 and is itself powered by the batteries 36*a* inside the starting barn 14. The connector 40 to the finishing post is also shown connected to the circuit board 35.

Each horse 13, in one form, includes an electromagnetic motor 37 and includes a variable resistor. The variable resistor is adjustable thereby to adjust the speed of the horse 13.

Alternatively, in another form, the horse 13 is propelled along the track on the action of a lever or pressure or without the action of an electromagnetic motor.

A kit for the racing game is now described.

The kit includes the following 4 major units.

1. Horse
2. Racing tracks
3. Starter
4. Finishing post

Horse

Adjusting a variable resistor inside the horse body can control horse speed.

A rechargeable battery as the horse's power source.

Alternatively, the horse can use a non-rechargeable battery.

Or even the horse could be in non-motorized and only with wind up mechanism.

The tail is the "On/Off" Switch.

Starting Gate System

There is a lever mechanism under each straight track.

All levers can be connected together by joining straight track horizontally and vertically.

Gates are installed on top of this lever mechanism.

To begin a race, press Start button. An actuator inside the Starter will drive the lever mechanism. Then all gates open simultaneously.

Start Racing

There is a magnetic sensor (reed switch) inside a horse body. This sensor can be used to enable or disable horse's driving motor Before starting, horse stays behind a closed gate. A permanent magnet inside the gate will attract the magnetic sensor and hence horse motor is disabled.

While starting, the gate is opened. The magnet flux direction and density are changed and hence horse motor is enabled.

Alternatively, this lever mechanism may be simply driven manually by means of force, e.g. push button, lever or gas pressure etc, without actuator.

Starter

Motor to drive lever mechanism

Built-in two individual chargers for charging the horse battery if rechargeable battery is used as source power.

If non-rechargeable battery is used or the horse is driven by mechanical system, no charger will be included.

Racing Track

The racing game is extendable by adding more horses, tracks, starters and ranking counters.

All horses will run the same length no matter the horses are running in inter or outer course.

Finishing Post

An electronic device that is able to detect the horse passing through it.

One post can detect two lanes. Up to max 3 posts can be cascaded together.

By sending and detecting the reflected IR signal from each post, it is able to find out who is the winner.

The above system could be applied to other means like a camel, or harness racing game. In some other cases there can be different farm animals for instance cows. There can be greyhounds or other representatives of humans or animals which are capable of being representative of racing against each other in a track environment.

In some cases, other than animals being represented as traversing the track, there can be cars or other vehicles.

The vehicles can have 2 or 4 wheels. They can be cars, trucks, bicycles motorbikes or the like. The vehicles can have one or more of the features described with regard to horses as part of the vehicle.

Figure 16:
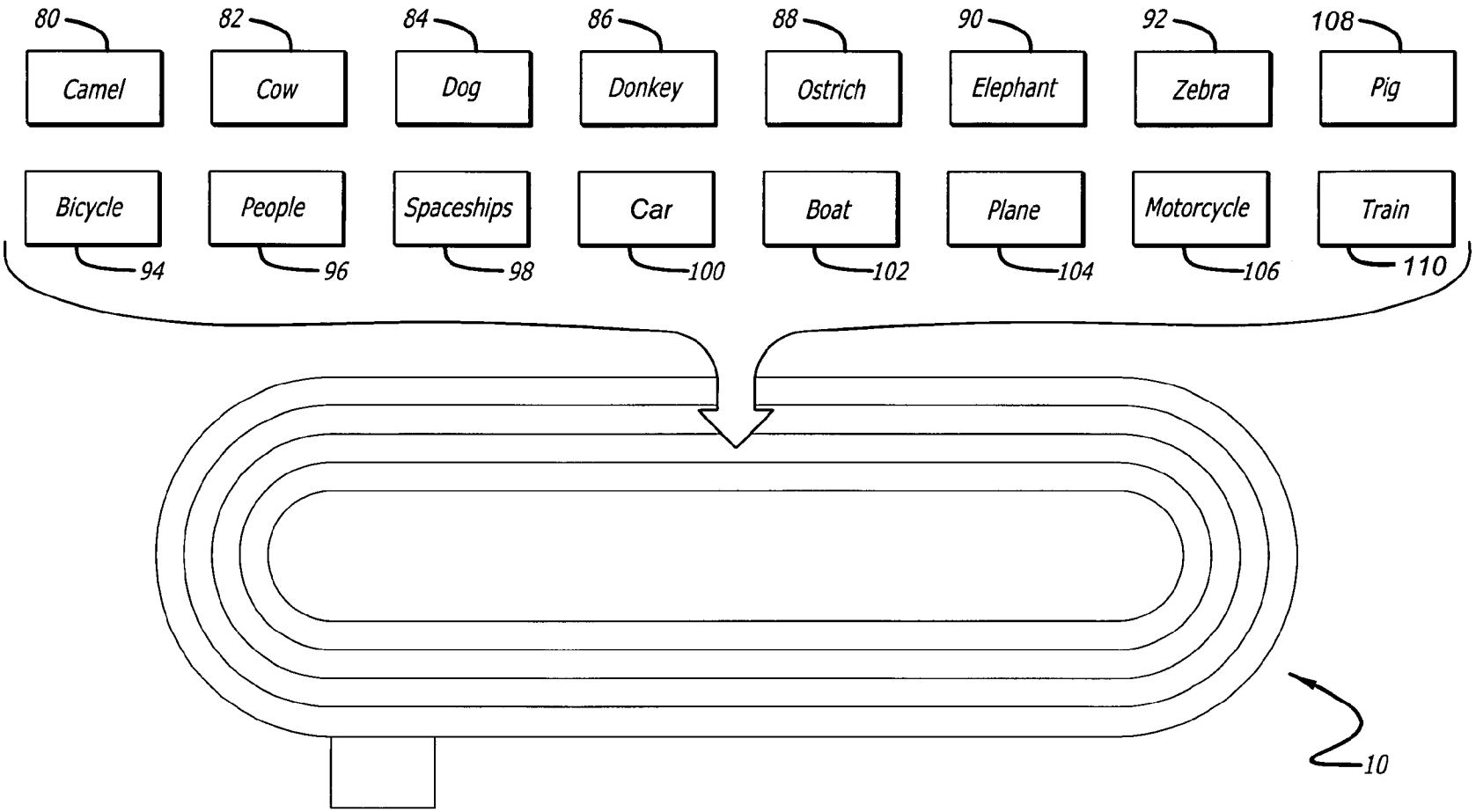
FIG. 16 is a block diagram representing different movable elements.

In other forms as represented in FIG. 16, there can be selectively one or more of different people 96, or animals, such as camel 80, cow 82, dog 84, donkey 86, ostrich 88, elephant 90, zebra 92, or pig 108. There can also be one or more of different vehicles, such as bicycle 94, spaceship 98, car 100, boat 102, plane 104, motorcycle 106, or train 110.

The track is constructed to simulate the real racing track and have the features associated with the real rack for the movable elements. Thus where there is simulated vehicle race there can be pits for representing stopping areas or refueling areas of racing vehicles.

Many more examples of the invention exist each differing from the other in matters of detail only.

The present disclosure is not limited to the embodiments described above, but includes any and all embodiments of the following claims.

I claim:

1. A racing toy game comprising:

a multi-track closed circuit comprised of multiple single tracks;

a respective starting gate for each respective single track of the circuit, each respective starting gate being for a single track and each starting gate being separate from other starting gates for other single tracks;

a finishing post for each respective track of the circuit;

the multiple movable elements each respectively for traversing a respective track of the circuit and thereby racing in relation to other movable elements in other tracks;

a starter associated with each respective starting gate, the starter being for operating the respective gates substantially simultaneously to permit initiation of the race; and the starting gate including a metal element, the metal element interacting with an electromagnetic motor in each respective movable element; and being such that the electromagnetic motor permits motion of the movable element.

2. A racing toy as claimed in claim 1 wherein the movable elements are represented by animals, selectively horses, and initiation of the race permitting the respective movable elements to traverse a respective track from the starting place towards the finishing place.

3. A racing toy as claimed in claim 1 wherein the starting gates for each respective track are connected such that initiation of the race effectively operates all the gates simultaneously.

4. A racing toy game comprising:

a multi-track closed circuit;

a respective starting gate for each respective track of the circuit;

a finishing post for each respective track of the circuit;

the multiple movable elements each respectively for traversing a respective track of the circuit and thereby racing in relation to other movable elements in other tracks;

a starter associated with each respective starting gate, the starter being for operating the respective gates substantially simultaneously to permit initiation of the race;

the starting gate for each track being located at a different relative location on the track relative to a different track such that on a closed track the movable element for the respective track traverses substantially the same distance between its starting gate and a finishing post, the finishing post being aligned for tracks, and each starting gate being at a non-adjacent transverse position relative to the stating gate on another track of the circuit; and the starting gate including a metal element, the metal element interacting with an electromagnetic motor in each respective movable element; and being such that the electromagnetic motor permits motion of the movable element.

5. A racing toy as claimed in claim 1 wherein the starting gate for each track is interlinked by a lever system, the lever system being functional below a level of the tracks on which the elements traverse.

6. A racing toy game comprising:

a multi-track closed circuit;

a respective starting gate for each respective track of the circuit;

a finishing post for each respective track of the circuit;

the multiple movable elements each respectively for traversing a respective track of the circuit and thereby racing in relation to other movable elements in other tracks; and a starter associated with each respective starting gate, the starter being for operating the respective gates substantially simultaneously to permit initiation of the race, and the gate includes an element hinged to move from a position across the track to a position substantially parallel and adjacent to the track, the gate including a metal element, the metal element interacting with a magnetic switch and an electromagnetic motor in each of a respective movable element such that wherein when the metal element is in closer adjacency with the magnetic switch in the movable element, the movable element is rendered stationary, and wherein when the metal element is in a position removed from the movable element the magnetic switch is on and the electromagnetic motor in the movable element is activated to permit motion of the movable element.

7. A racing toy as claimed in claim 1 wherein in the movable element and includes a rechargeable battery, and wherein the toy includes a source for recharging the rechargeable battery.

8. A racing toy as claimed in claim 1 wherein the movable element includes a switch for permitting activation of an electromagnetic motor in the movable element.

9. A racing toy as claimed in claim 1 including an electronic sensor associated with the finishing post, the electronic sensor being for determining which movable element reaches the finishing post first and selectively other movable elements at different times.

10. A racing toy as claimed in claim 1 including a starting mechanism associated with the tracks, the starting mechanism being a lever connected with a lever associated with each track, and the lever associated with each track being associated with the starting gate of each track.

11. A racing toy as claimed in claim 1 wherein the movable element is propelled along the track on the action of a lever or pressure or without the action of an electromagnetic motor.

12. A racing track as claimed in claim 1 wherein each movable element includes an electromagnetic motor and includes a variable resistor, the variable resistor being adjustable thereby to adjust the speed of the movable element, the motor being for propelling the respective movable elements along the track.

13. A racing toy game comprising:

a multi-track closed circuit comprised of multiple single tracks;

a respective starting place for each respective single track of the circuit, each respective starting place being for a single track and each respective starting place being separate from another respective starting place for another single track, and each respective starting place being at a non-adjacent transverse position relative to another respective stating place on another single track of the circuit;

a finishing place for each respective track of the circuit;

the multiple movable elements each respectively for traversing a respective track of the circuit and thereby racing in relation to other movable elements in other tracks;

a starter associated with each respective starting place, the starter being for operating the respective starting places substantially simultaneously to permit initiation of the race; and the starting place including a metal element, the metal element interacting with an electromagnetic motor in each respective movable element; and being such that the electromagnetic motor permits motion of the movable element.

14. A racing toy as claimed in claim 13 wherein the movable elements are represented by selectively one or more of different vehicles, different animals, different water vehicles, different air vehicles, different rail vehicles, or different persons, and initiation of the race permitting the respective movable elements to traverse a respective track from the starting place towards the finishing place.

15. A racing toy as claimed in claim 13 wherein the starting places for each respective track are connected such that initiation of the race effectively operates all the places simultaneously.

16. A racing toy game comprising:

a multi-track closed circuit;

a respective starting place for each respective track of the circuit;

a finishing place for each respective track of the circuit;

the multiple movable elements each respectively for traversing a respective track of the circuit and thereby racing in relation to other movable elements in other tracks;

a starter associated with each respective starting place, the starter being for operating the respective places substantially simultaneously to permit initiation of the race, and the starting place for each track being located at a different relative location on the track relative to a different track such that on a closed track the movable element for the respective track traverses substantially the same distance between its starting place and a finishing place, the finishing place being aligned for tracks; and the starting gate including a metal element, the metal element interacting with an electromagnetic motor in each respective movable element; and being such that the electromagnetic motor permits motion of the movable element.

17. A racing toy as claimed in claim 13 wherein the starting place for each track is interlinked by a lever system, the lever system being functional below a level of the tracks on which the elements traverse.

18. A racing toy game comprising:

a multi-track closed circuit;

a respective starting place for each respective track of the circuit;

a finishing place for each respective track of the circuit;

the multiple movable elements each respectively for traversing a respective track of the circuit and thereby racing in relation to other movable elements in other tracks; and a starter associated with each respective starting place, the starter being for operating the respective places substantially simultaneously to permit initiation of the race, and the starting place includes an element hinged to move from a position across the track to a position substantially parallel and adjacent to the track, the starting place including a metal element, the metal element interacting with a magnetic switch and an electromagnetic motor in each of a respective movable element such that wherein when the metal element in closer adjacency with the magnetic switch in the movable element, the movable element is rendered stationary, and wherein when the metal element is in a position removed from the movable element the magnet switch is on and the electromagnetic motor in the movable element is activated to permit motion of the movable element.

19. A racing toy as claimed in claim 1 wherein in the movable element and includes a rechargeable battery, and wherein the toy includes a source for recharging the rechargeable battery.

20. A racing toy as claimed in claim 13 including an electronic sensor associated with the finishing place, the electronic sensor being for determining which movable element reaches the finishing place first and selectively other movable elements at different times.

21. A racing toy as claimed in claim 13 including a starting mechanism associated with the tracks, the starting mechanism being a lever connected with a lever associated with each track, and the lever associated with each track being associated with the starting place of each track.

22. A racing track as claimed in claim 13 wherein each electromagnetic motor includes a variable resistor, the variable resistor being adjustable thereby to adjust the speed of the movable element, the motor being for propelling the respective movable elements along the track.

* * * * *